US007237427B2

(12) United States Patent
Viegener

(10) Patent No.: US 7,237,427 B2
(45) Date of Patent: Jul. 3, 2007

(54) PRESSING TOOL FOR THE PRESSING-TOGETHER OF WORKPIECES

(75) Inventor: Walter Viegener, Attendorn (DE)

(73) Assignee: Viega GmbH & Co. KG, Attendorn (DE)

( * ) Notice: Subject to any disclaimer, the term of this patent is extended or adjusted under 35 U.S.C. 154(b) by 127 days.

(21) Appl. No.: 11/116,339

(22) Filed: Apr. 28, 2005

(65) Prior Publication Data

US 2005/0241359 A1 Nov. 3, 2005

(30) Foreign Application Priority Data

Apr. 30, 2004 (DE) ..... 20 2004 007 034 U

(51) Int. Cl.
*B21D 39/04* (2006.01)

(52) U.S. Cl. ..... 72/416; 72/409.01; 29/237; 29/282

(58) Field of Classification Search ..... 72/409.01, 72/416; 29/237, 282, 283.5; 81/307–309
See application file for complete search history.

(56) References Cited

U.S. PATENT DOCUMENTS 2,415,896 A * 2/1947 Bly et al. ..... 29/243.517
2,861,490 A * 11/1958 Rozmus ..... 72/399
3,015,824 A * 1/1962 Richardson ..... 72/399
3,120,772 A * 2/1964 Mixon, Jr. ..... 72/409.14
3,216,291 A * 11/1965 Madeira ..... 81/9.3
3,688,553 A * 9/1972 Demler ..... 72/409.01
5,195,353 A * 3/1993 Erbrick et al. ..... 72/409.11
5,267,464 A * 12/1993 Cleland ..... 72/409.12
6,694,586 B1 * 2/2004 Goop ..... 29/234

FOREIGN PATENT DOCUMENTS

DE 42 06 439 A1 9/1993
DE 42 40 427 C1 9/1993
EP 1 095 739 B1 5/2001

* cited by examiner

*Primary Examiner*—Daniel C. Crane
(74) *Attorney, Agent, or Firm*—Barnes & Thornburg LLP

(57) ABSTRACT

A pressing tool includes at least two pressing jaws hinged together to enclose a workpiece having an inserted pipe end. The pressing tool also includes an opening area located between the at least two pressing jaws and at least one hinge pin arranged opposite the opening area. Further included is a pressing element located adjacent to the at least one hinge pin and arranged to be moved to the workpiece during a closing of the at least two pressing jaws.

6 Claims, 8 Drawing Sheets

PRESSING TOOL FOR THE PRESSING-TOGETHER OF WORKPIECES

This application claims benefit of German Application 20 2004 007 034.0 filed Apr. 30, 2004, which disclosure is hereby incorporated by reference herein.

BACKGROUND AND SUMMARY

The present disclosure relates to a pressing tool for the pressing-together of workpieces. More particularly, the present disclosure relates to a workpiece such as a fitting with an inserted pipe end, the pressure tool having at least two pressing jaws which are hinged to one another for enclosing the workpiece, and a hinge axis is arranged opposite an opening area of the pressing jaws.

From German Patent Document DE 42 40 427, a pressing tool with several pressing jaw elements is known, which are hinged to one another and, in an opening area, can be pulled together by a pressing jaw in order to press a workpiece received in the pressing jaw elements. In this case, an opening gap is necessarily provided between adjacent pressing jaw elements, in which the material to be pressed may be squeezed to the outside and will form wrinkles. Specifically in the pressing plane, a plane perpendicular to the pressing force of the jointing clamp, pressing forces can be transmitted only poorly to the workpiece.

Furthermore, a pressing tool is known from European Patent Document EP 1 095 739 which has only two pressing jaws which are hinged to one another by a pin. On the side situated opposite the pin, an opening gap is constructed which is closed during the pressing. The risk also exists here that, during the pressing-together, a wrinkle can form in the opening gap because of the lack of a pressing in the radial direction.

The present disclosure relates to providing a pressing tool having pressing forces that can be applied in a uniform manner and a formation of wrinkles in an opening area is avoided.

According to the present disclosure, a pressing element is disposed on a hinge pin, which pressing element can be moved toward a workpiece when the pressing jaws are closed. The pressing element presses the workpiece during a pressing-together in a direction of a opening area of the pressing jaws. As a result of counterforces occurring there, forces for the pressing-together of the workpiece exist on all sides. The pressing element is first arranged in a slightly withdrawn position before the pressing-together and, when the pressing jaws are closed, the workpiece can first be pressed in a direction of the hinge pin in order to first slightly close the pressing jaws. However, in a next phase, pressing forces are then also applied in an area of a pressing plane between the opening area and the hinge pin. By a uniform pressing-together of the workpiece, it may become possible to avoid a wrinkle formation in the area of the opening because, in this area, pressing forces are applied only when the pressing jaws are largely closed.

According to an embodiment of the present disclosure, the pressing element has wedge surfaces on a side facing the pressing jaws, to which wedge surfaces pressure surfaces of the pressing jaws are applied during the pressing-together of the workpiece. Therefore, as a result of the closing movement of the pressing jaws, the pressing element can be moved in the radial direction to the workpiece. By a selection of an angle of the wedge surfaces, a moving path of the pressing element during the closing movement of the pressing jaws can be defined. Thus, a corresponding intensification of force can be achieved.

As disclosed herein, two pressing jaws are provided which can be rotated about a hinge constructed as a pin. However, it is conceivable to mutually connect in a hinged manner more than two pressing jaws in order to implement a pressing-together by a wrap-around ring. The providing of only two pressing jaws means that only a few components are required for the pressing tool. Thus, the pressing element can have a leg with an oblong hole, and the pin can reach through this oblong hole. This is a simple way of displaceably fixing the pressing element. For an exact guidance of the pressing element, two legs can reach around the pressing jaws in a U-shaped manner.

In order to be able to apply pressing forces in the area of the pressing plane, the pressing jaws have projections adjacent to the opening area, which projections mesh with one another in a comb-type manner when the pressing jaws are closed. A recess on an opposite pressing jaw can be assigned to each projection of a pressing jaw. Although, in the opening area, a gap should still be formed between the pressing jaws before the pressing-together. This gap would no longer extend over an entire width of the pressing jaws but would be divided by the projections into several smaller sections. As a result, a risk of a wrinkle formation in the area between the pressing jaws may be avoided because the individual projections support the workpiece in this area.

Other aspects of the present disclosure will become apparent from the following descriptions when considered in conjunction with the accompanying drawings.

DETAILED DESCRIPTION

Figure 1:
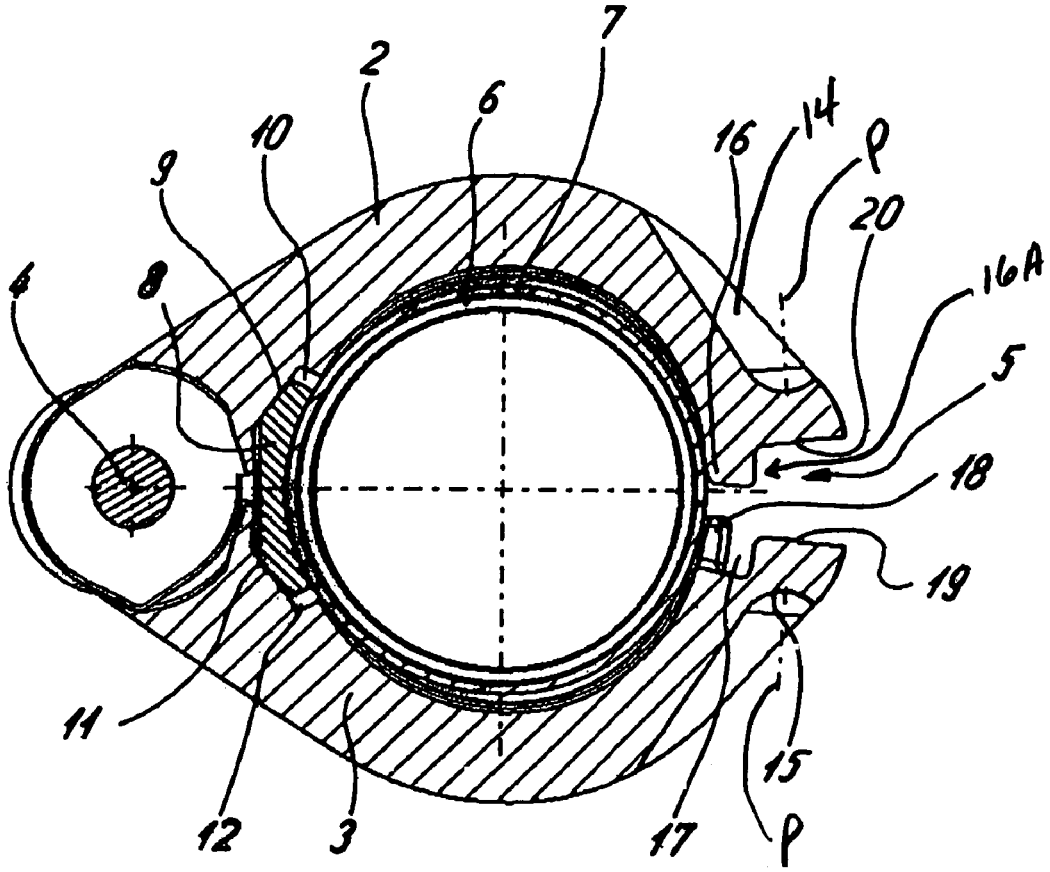
FIG. 1 is a sectional side view of an embodiment of a pressing tool in an opened condition, according to the present disclosure.

A pressing tool 1 comprises two pressing jaws 2 and 3 which are mutually connected by a hinge axis constructed as a pin 4. On a side of the pressing jaws 2 and 3 situated opposite the pin 4, an opening area 5 is constructed so that a fitting or a workpiece 6 can be inserted between the pressing jaws 2 and 3. At first the workpiece 6 is only loosely enclosed by the pressing jaws 2 and 3. In an embodiment shown, for example, in FIG. 1, the workpiece 6 is constructed as a metal fitting, into which a pipe end can be inserted. On the workpiece 6, a ring-shaped elevation 7 is provided which has a sealing ring therein. The pressing jaws 2 and 3 have an inside contour intended for a pressing-together, to which inside contours the shape of the workpiece 6 is adapted. The extent of the material deformation as a result of the pressing-together can be adapted to a particular usage.

On a side of the pin 4, a pressing element 8 is provided. Half of the pressing element 8 is received in each of the pressing jaws 2 and 3, respectively. In an edge area, the pressing element 8 has wedge-shaped surfaces 9 and 11 which are constructed to engage with pressure surfaces 10 and 12 extending essentially parallel thereto. As a result, by a closing of the pressing jaws 2 and 3 during a rotation about the pin 4, the pressure surfaces 10 and 12 press upon the wedge surfaces 9 and 11, and thereby move the pressing element 8 toward the workpiece 6.

On a side situated opposite the pin 4, a recess 14 is provided on the pressing jaw 2 and a receiving device 15 is provided on the pressing jaw 3 for an engagement with a jointing clamp (not shown). By a pressing-together of the jointing clamp in a direction of a pressing plane P, the pressing jaws 2 and 3 are closed and the workpiece 6 is pressed together.

In the opening area 5, the pressing jaw 2 has a projection 16 which protrudes beyond a lateral surface 20. On an opposite side, the pressing jaw 3 has a receiving device 17 which is dimensioned such that it can receive the projection 16 and is constructed to be set back with respect to a lateral surface 19. Behind the recess 17, a projection 18 is constructed on the pressing jaw 3, which can engage in a correspondingly constructed receiving device 16A on the pressing jaw 2. The projections 16 and 18 therefore mesh with one another in a comb-type manner during the closing of the pressing jaws 2 and 3.

Figure 2:
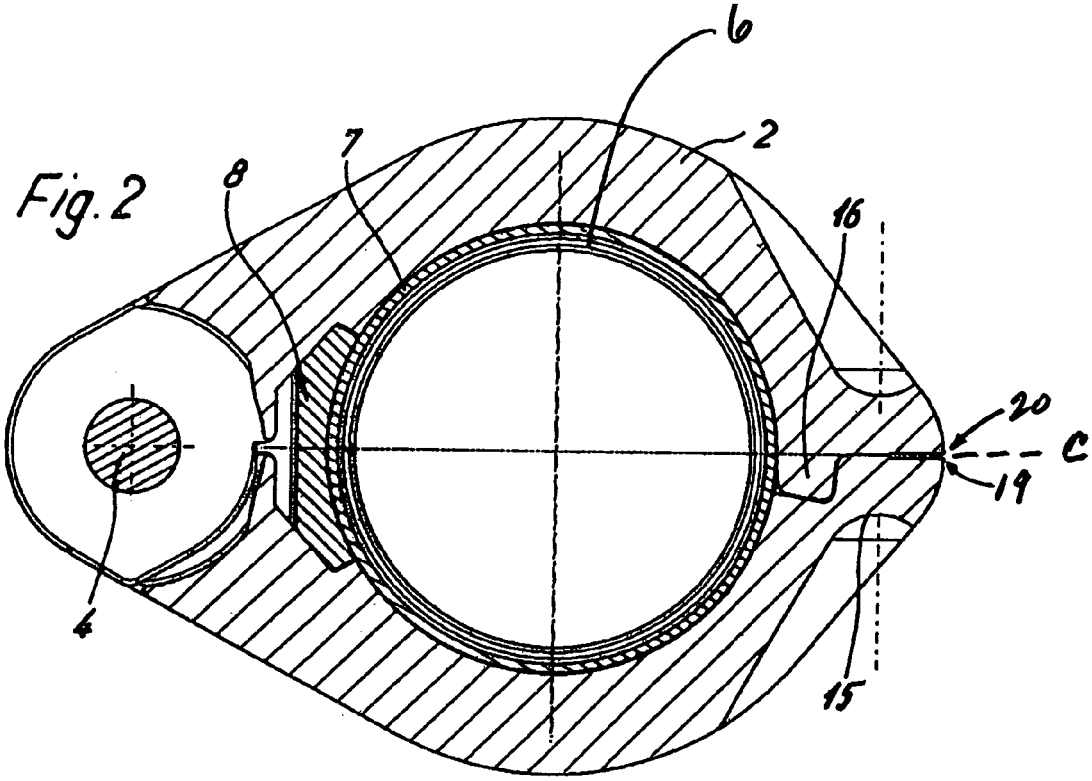
FIG. 2 is a sectional side view of the pressing tool of FIG. 1 in a closed condition.

FIG. 2 shows the pressing jaws 2 and 3 in the closed position, the lateral surfaces 19 and 20 resting against one another. The projection 16 reaches beyond a closing plane C into the receiving device 17 of the pressing jaw 3. In addition, during closing of the pressing jaws 2 and 3, the pressing element 8 is pressed against the workpiece 6, and the inside contour of the pressing jaws 2 and 3 as well as of the pressing element 8 form a straight pressing contour without kinks and steps.

Figure 3:
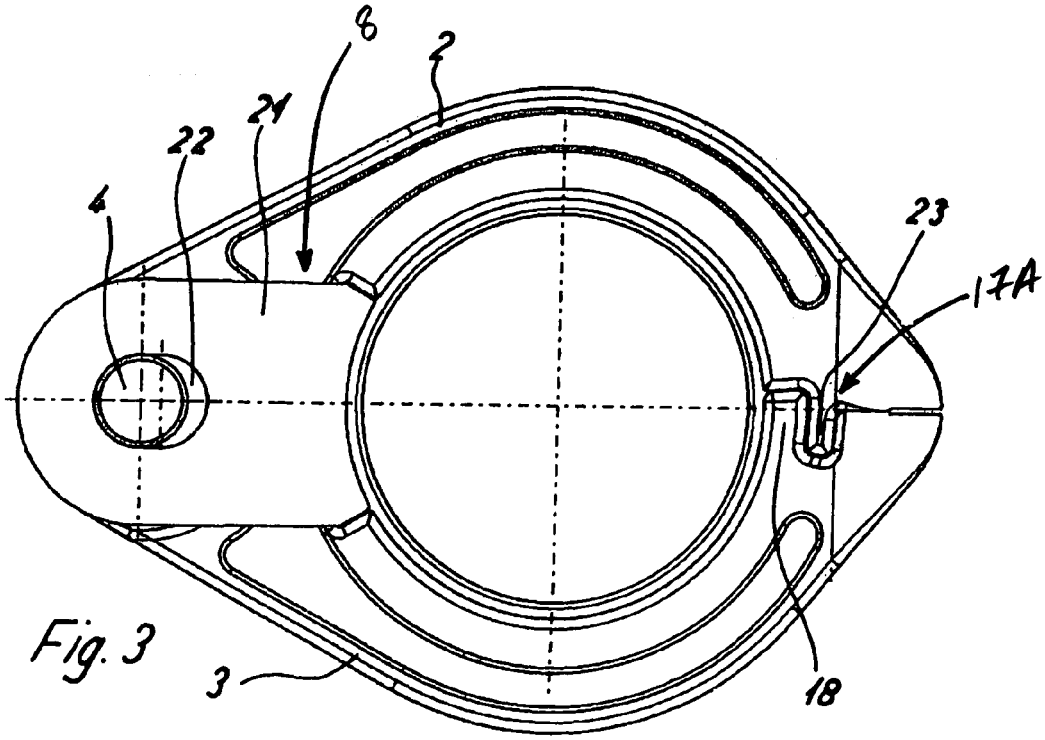
FIG. 3 is a side view of the pressing tool of FIG. 1 in a closed condition.

As illustrated in FIG. 3, legs 21 are shaped onto the pressing element 8 on opposite sides of the pressing jaws 2 and 3. Legs 21 include an oblong hole 22 constructed thereon. Pin 4 reaches through the oblong hole 22, so that the pressing element 8 can be moved along the oblong hole 22 relative to the pin 4. Legs 21 provide a lateral guidance of the pressing element 8.

On an opposite side, the projection 18 of the pressing jaw 3 engages in corresponding receiving device 16A of the pressing jaw 2. A projection 23 of the pressing jaw 2 is spaced radially from the workpiece 6 engaging in a receiving device 17A. In a case of high pressing forces, the comb-type meshing of projections 16, 18 and 23 with receiving devices 16A, 17 and 17A provides a desired support.

Figure 4:
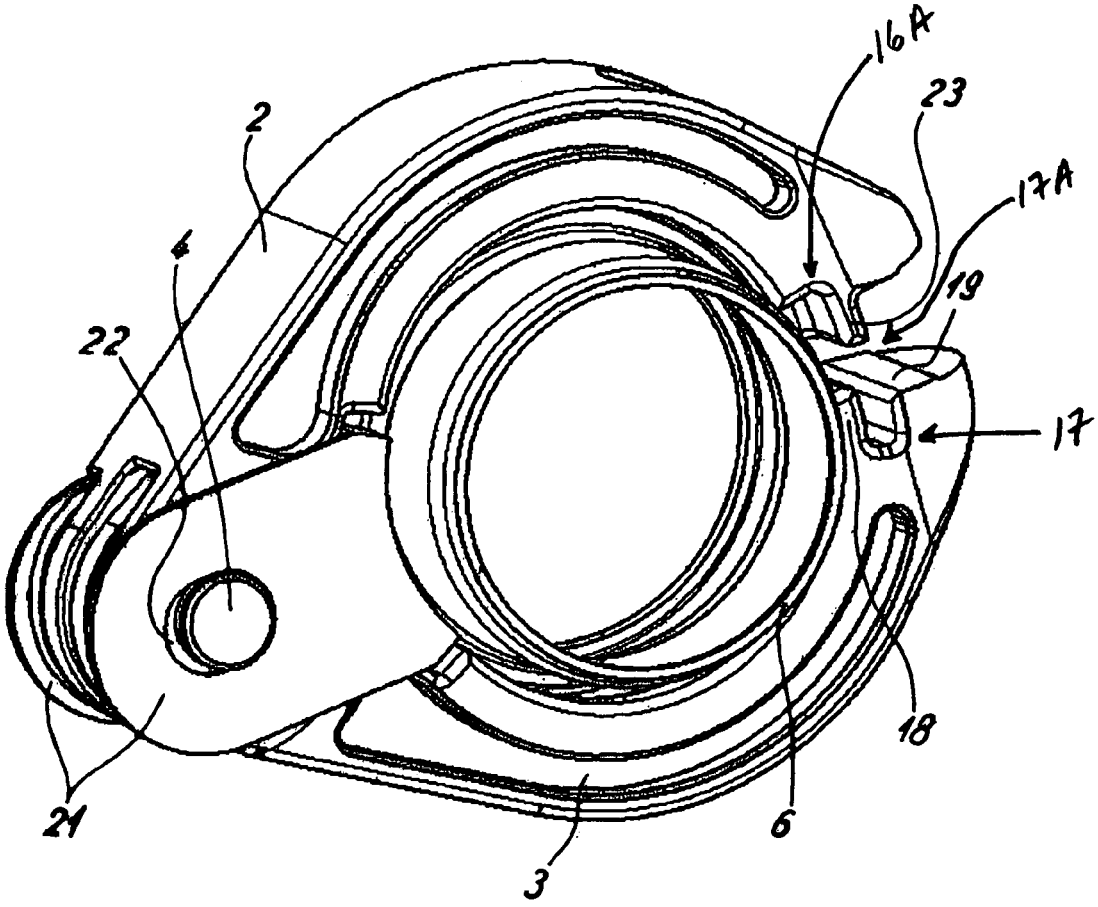
FIG. 4 is a perspective view of the pressing tool of FIG. 1 in an opened condition.

As illustrated in FIG. 4, the legs 21 reach around the pressing jaws 2 and 3 in a U-shaped manner, so that the pressing element 8 is captively held on the pressing tool 1. In the opened position, the pressing jaws 2 and 3 are at first placed loosely around the fitting 6, and then the jointing clamp is applied to the receiving devices 14 and 15 in order to close the pressing jaws 2 and 3.

At the start of the pressing operation, the pressing jaws 2 and 3 are first moved toward one another, and the fitting 6 is pressed to the pressing element 8. Subsequently, the pressing element 8 rests on the fitting 6 and is pressed in the direction of the comb-type projections 16 and 18 by the pressing jaws 2 and 3. This provides a contact pressure in the area of the pressing plane P.

The pressing tool 1 is particularly suitable for the pressing-together of pipe connections. Other fittings or workpieces can also be pressed together.

Figure 5A:
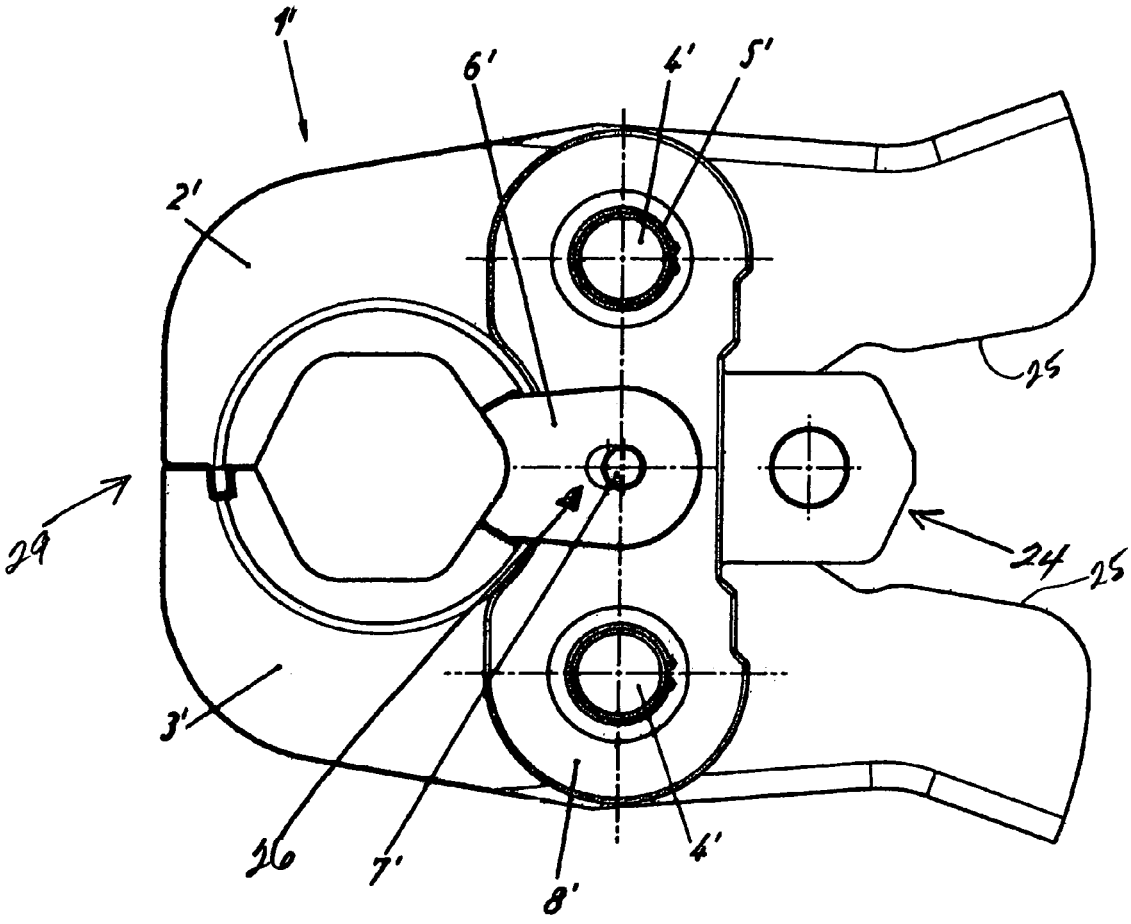
FIG. 5A is a top view of another embodiment of a pressing tool, according to the present disclosure.
Figure 5B:
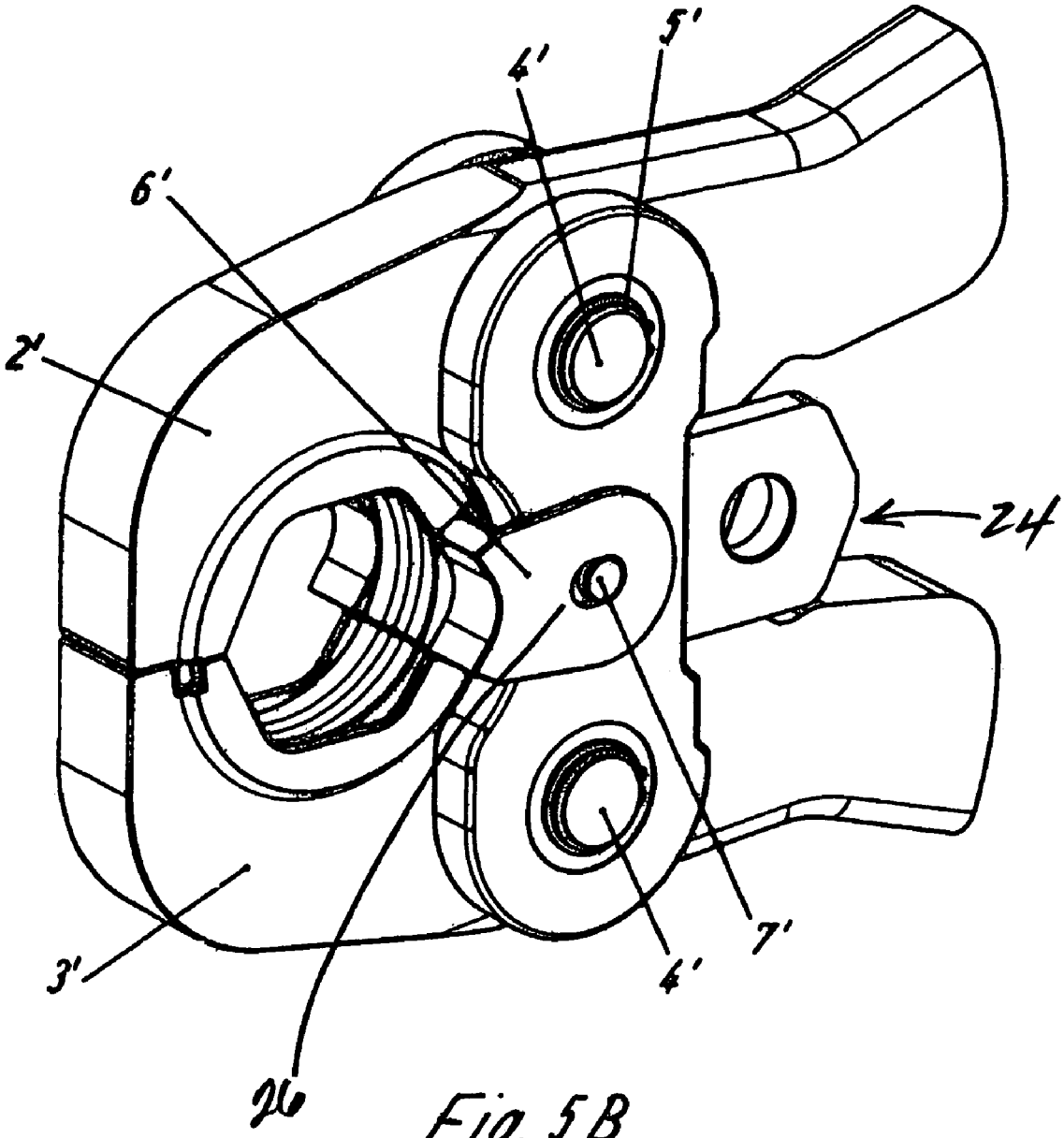
FIG. 5B is a perspective view of the pressing tool of FIG. 5A.

FIGS. 5A and 5B show another embodiment of a pressing tool 1', which is constructed as an attachment Two mutually opposite pressing jaws 2' and 3' are provided which form a pressing opening with, for example, a hexagonal cross-section and a median ring-shaped section. The jaws 2' and 3' can be rotated about mutually spaced axes 4'. The axes 4' are constructed as pins and are fixed in the axial direction by a snap ring 5'. The two axes 4' are mutually connected by a holding element 8'.

By movement of a piston (not shown), connected to clevis 24 (see FIGS. 5A and 5B) mutually opposite wedge surfaces 25 are pressed apart and the pressing jaws 2' and 3' are thereby moved toward one another for a pressing-together of, for example, a pipe. A pressing element 6' arranged between the pressing jaws 2' and 3' is moved in a radial direction toward a press opening 29, the pressing jaws 2' and 3', as in the preceding embodiment, acting upon corresponding wedge surfaces (not shown). The pressing element 6' is displaceably disposed by two legs on a pin 7' by an oblong hole 26. In a forward area, the pressing jaws 2', 3' have a comb-type construction as in the preceding embodiment.

Figure 6:
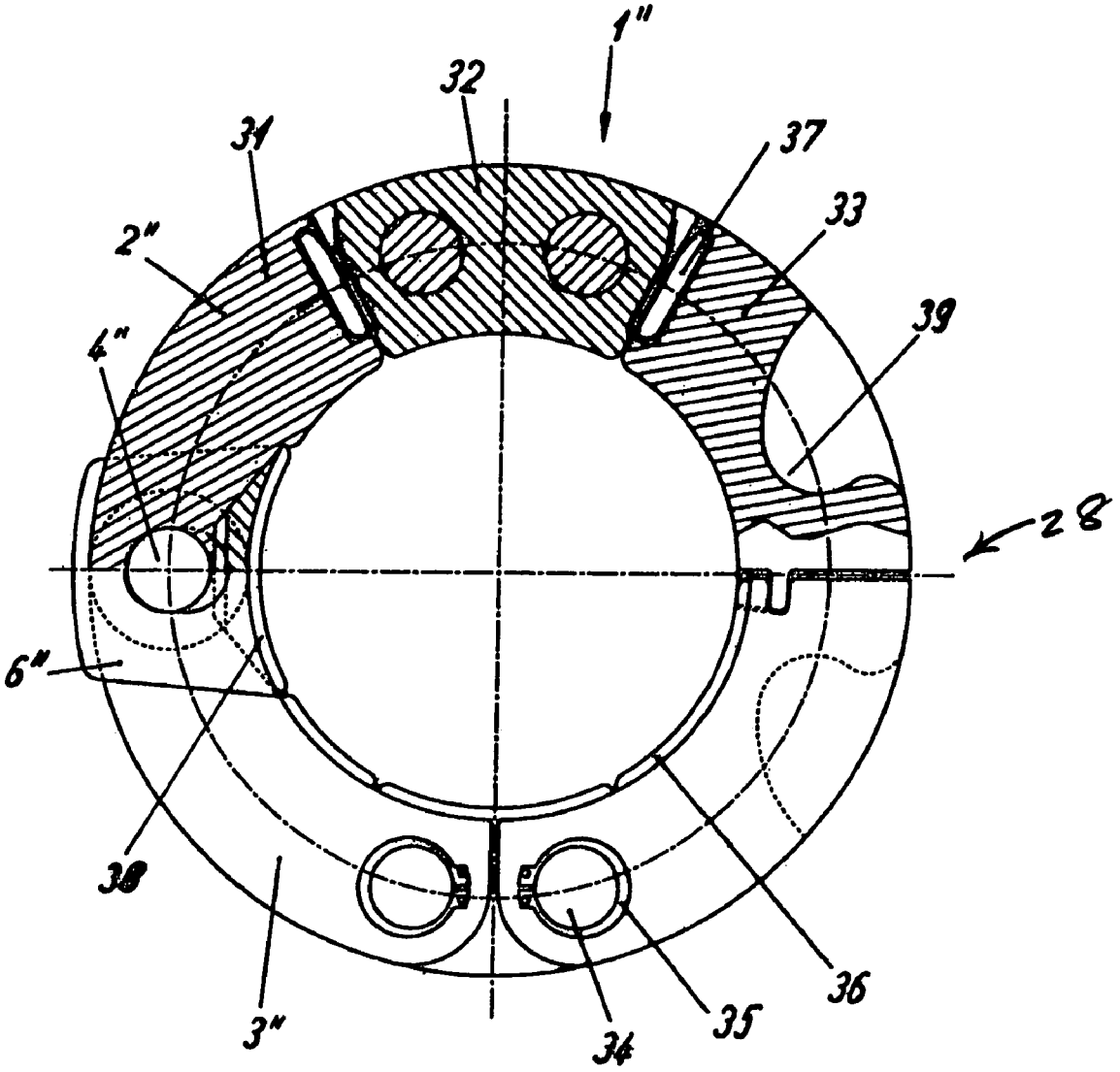
FIG. 6 is a top view of another embodiment of a pressing tool, according to the present disclosure.

FIG. 6 illustrates a pressing tool 1" constructed as a pressing chain, in which the pressing jaws 2" and 3" are formed of several members 31, 32 and 33 which can be placed against one another on an inner surface for forming a pressing surface 36. The pressing jaws 2" and 3" can be rotated about a pin 4". Adjacent to the pin 4", a pressing element 6" is provided which can be displaced in the radial direction and which, in a closed position, forms a section 38 of the pressing surface 36.

The individual members 31, 32 and 33 are rotatably linked by pins 34, the pins 34 each being fixed in the axial direction by a snap ring 35. Furthermore, the members 31, 32, and 33 are prestressed by spring elements 37 for facilitating a mounting in a closed position. The pressing chain is pulled together by a jointing clamp, (not shown). The jointing clamp engages receiving devices 39 on the pressing jaws 2" and 3". The members 33 of the pressing jaws 2" and 3", which are arranged adjacent to an opening area 28, engage in one another in a comb-type manner during the pressing-together.

Figure 7A:
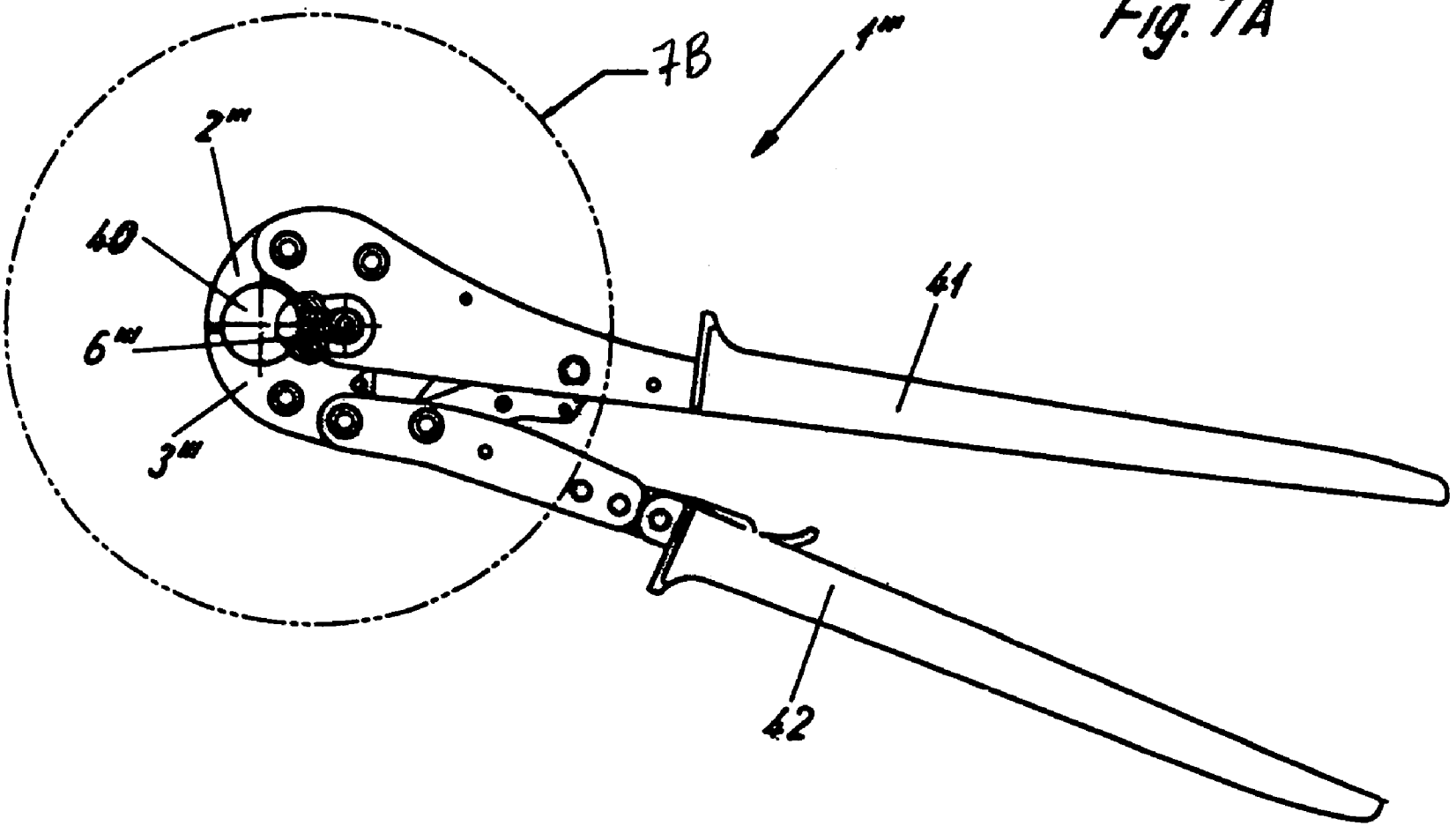
FIG. 7A is a top view of another embodiment of a pressing tool, according to the present disclosure.
Figure 7B:
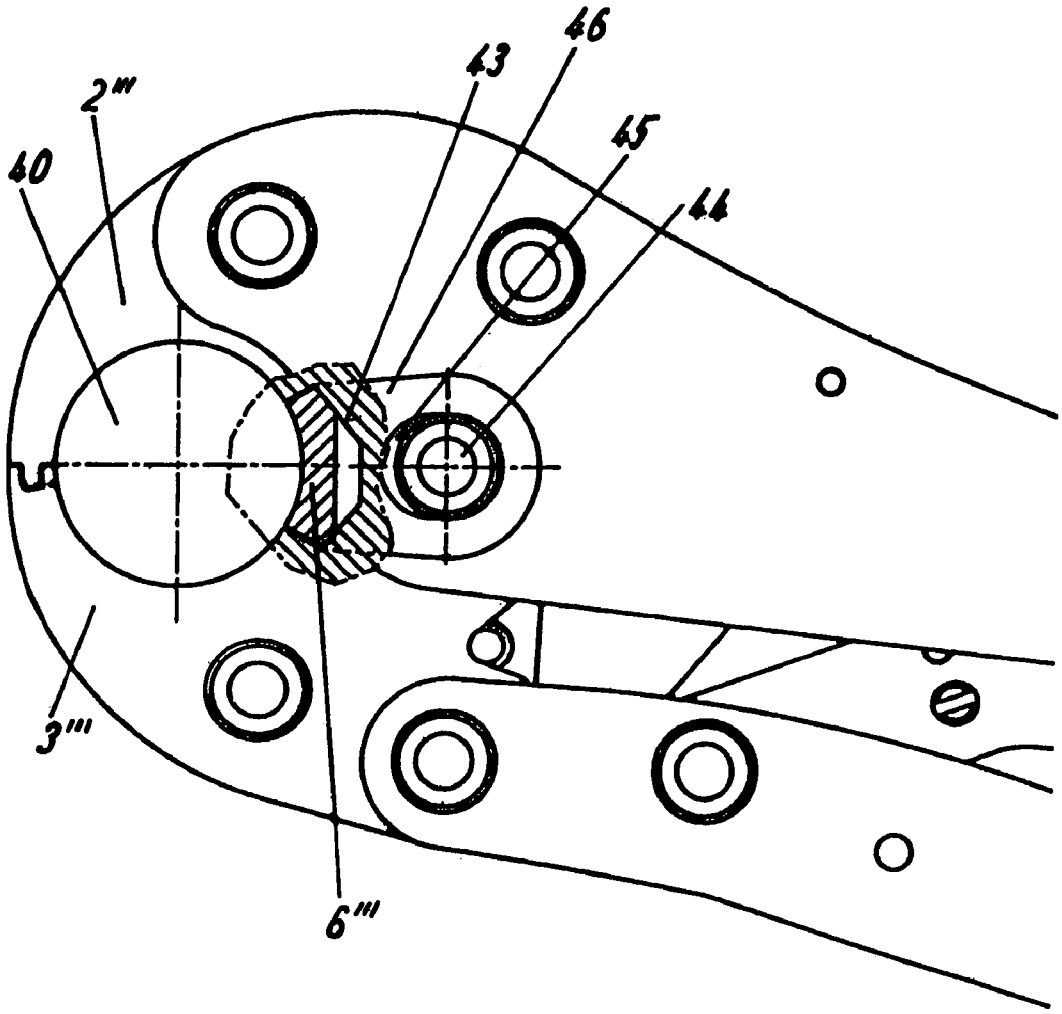
FIG. 7B is an enlarged view of a detail of the pressing tool of FIG. 7A.

FIGS. 7A and 7B illustrate a pressing tool constructed as a jointing clamp 1" and includes two pressing jaws 2''' and 3''' which enclose an inner pressing opening 40. The pressing jaws 2''' and 3''' can be swivelled by a hinge mechanism and can be manually moved by two gripping levers 41 and 42. Between the pressing jaws 2''' and 3''', a pressing element 6''', which can be displaced to the pressing opening 40, is arranged on a side of the swivelling axis. Pressing element 6''' can be moved by two wedge surfaces 43. The wedge surfaces 43 may not be arranged on the pressing jaws 2''' and 3''' but may be arranged on other movable components of the hinge mechanism. The pressing element 6''' is displaceably disposed on a pin 44 which reaches through an oblong hole 45 on a leg 46 of the pressing element 6'''.

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A pressing tool for the pressing together of a workpiece having an inserted pipe end, the pressing tool comprising:

at least two pressing jaws hinged together by at least one hinge pin to enclose the workpiece; and a pressing element located adjacent to the at least one hinge pin and arranged to be moved toward the workpiece during a closing of the at least two pressing jaws;

wherein on a side facing the at least two pressing jaws, the pressing element includes wedge surfaces to which pressure surfaces of the at least two pressing jaws are applied during a pressing-together of the workpiece; and wherein the pressing element is forced by the pressure surfaces of the at least two pressing jaws towards the workpiece during closing of the at least two pressing jaws.

2. The pressing tool according to claim 1, wherein the at least two pressing jaws are rotated about a hinge axis constructed as a pin.

3. The pressing tool according to claim 1, wherein the pressing element includes a leg having an oblong hole, and a pin reaching through the oblong hole.

4. The pressing tool according to claim 1, wherein the pressing element includes two legs that reach around the at least two pressing jaws in a U-shaped manner, the pressing element being guided on the legs.

5. The pressing tool according to claim 1, wherein each of the at least two pressing jaws includes a projection adjacent to an opening area located between the at least two pressing jaws, which projections engage one another in a comb-type manner when the at least two pressing jaws are closed.

6. The pressing tool according to claim 5, wherein each of the at least two pressing jaws includes a receiving device assigned to one of the projections on an opposing pressing jaw.

* * * * *